US008925379B2

(12) United States Patent
Yamate et al.

(10) Patent No.: US 8,925,379 B2
(45) **Date of Patent: *Jan. 6, 2015**

(54) DOWNHOLE SENSOR SYSTEMS AND METHODS THEREOF

(71) Applicant: Schlumberger Technology Corporation, Sugar Land, TX (US)

(72) Inventors: Tsutomu Yamate, Yokohama (JP); Toru Terabayashi, Sagamihara (JP); Ricardo Vasques, Holte (DK); Kazumasa Kanayama, Hachioji (JP); Yuji Hosoda, Sagamihara (JP); Stephane Briquet, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/764,787

(22) Filed: Feb. 12, 2013

(65) Prior Publication Data

US 2013/0145837 A1 Jun. 13, 2013

Related U.S. Application Data

(62) Division of application No. 12/758,031, filed on Apr. 12, 2010, now Pat. No. 8,397,561.

(60) Provisional application No. 61/168,218, filed on Apr. 10, 2009.

(51) Int. Cl.

| | |
|---|---|
| ***E21B 47/10*** | (2012.01) |
| ***E21B 49/08*** | (2006.01) |
| ***E21B 49/00*** | (2006.01) |

(52) U.S. Cl.

CPC ..... *E21B 49/08* (2013.01); *E21B 49/00* (2013.01)

USPC ..... 73/152.18

(58) Field of Classification Search

USPC ..... 73/152.18, 152.23–152.28

See application file for complete search history.

(56) References Cited

U.S. PATENT DOCUMENTS

| | | | |
|---|---|---|---|
| 3,780,575 | A | 12/1973 | Urbanosky |
| 3,859,851 | A | 1/1975 | Urbanosky |
| 4,860,581 | A | 8/1989 | Zimmerman et al. |

(Continued)

FOREIGN PATENT DOCUMENTS

| | | |
|---|---|---|
| EP | 1347150 | 5/2006 |

OTHER PUBLICATIONS

NeSSI (New Sampling/Sensor Initiative), http://www.cpac.washington.edu/NeSSI/NeSSI.htm.

(Continued)

*Primary Examiner* — John Fitzgerald

(74) *Attorney, Agent, or Firm* — Daryl R. Wright; Jody DeStefanis

(57) ABSTRACT

A sensor module for a sensing apparatus configured for operation downhole, within a borehole. The sensor module comprises a sensor array having a plurality of sensors to sense selected formation parameters and a control system for selective and independent operation of each sensor of the sensor array. Each sensor of the sensor array is configured or designed as a discrete sensor unit for individual and independent communication and control. Each sensor of the sensor array may have an associated electronics module that provides standardized electronic connectivity with the control system.

16 Claims, 6 Drawing Sheets

(56) References Cited

U.S. PATENT DOCUMENTS

| | | | | |
|---|---|---|---|---|
| 4,945,775 | A * | 8/1990 | Adams et al. | 73/865.8 |
| 5,179,541 | A * | 1/1993 | Weido | 367/69 |
| 6,058,773 | A | 5/2000 | Zimmerman et al. | |
| 6,213,250 | B1 * | 4/2001 | Wisniewski et al. | 181/104 |
| 6,942,043 | B2 * | 9/2005 | Kurkoski | 175/40 |
| 6,978,656 | B2 * | 12/2005 | Blakley | 73/24.06 |
| 7,117,743 | B2 * | 10/2006 | Blakley | 73/602 |
| 7,178,591 | B2 | 2/2007 | Del Campo et al. | |
| 7,366,624 | B2 * | 4/2008 | Wobschall | 702/91 |
| 7,367,392 | B2 * | 5/2008 | Duong et al. | 166/249 |
| 7,394,257 | B2 * | 7/2008 | Martinez et al. | 324/356 |
| 7,581,440 | B2 * | 9/2009 | Meek et al. | 73/152.24 |
| 7,600,420 | B2 * | 10/2009 | Meek | 73/152.54 |
| 7,703,317 | B2 * | 4/2010 | Goodwin et al. | 73/152.24 |
| 7,779,684 | B2 * | 8/2010 | Meek et al. | 73/152.24 |
| 7,788,972 | B2 | 9/2010 | Terabayashi et al. | |
| 7,805,988 | B2 | 10/2010 | Kasperski et al. | |
| 7,845,219 | B2 * | 12/2010 | Goodwin et al. | 73/152.24 |
| 8,256,283 | B2 | 9/2012 | Terabayashi et al. | |
| 8,397,561 | B2 * | 3/2013 | Yamate et al. | 73/152.18 |
| 2003/0173115 | A1 * | 9/2003 | Krueger et al. | 175/59 |
| 2004/0251048 | A1 | 12/2004 | Kurkoski | |
| 2005/0236155 | A1 | 10/2005 | Killie et al. | |
| 2006/0243047 | A1 | 11/2006 | Terabayashi et al. | |
| 2008/0066536 | A1 * | 3/2008 | Goodwin et al. | 73/152.24 |
| 2008/0078241 | A1 | 4/2008 | Tchakarov | |
| 2008/0115574 | A1 * | 5/2008 | Meek | 73/152.03 |
| 2008/0156088 | A1 | 7/2008 | Hsu et al. | |
| 2008/0173083 | A1 | 7/2008 | Kasperski et al. | |
| 2008/0245570 | A1 | 10/2008 | Partouche | |
| 2009/0150079 | A1 | 6/2009 | Hsu et al. | |
| 2009/0158837 | A1 * | 6/2009 | Meek et al. | 73/152.24 |
| 2009/0211752 | A1 * | 8/2009 | Goodwin et al. | 166/250.02 |
| 2009/0296086 | A1 | 12/2009 | Appel et al. | |

OTHER PUBLICATIONS

Decision on grant for the equivalent Russian patent application No. 2011145569 issued on Mar. 21, 2014.

* cited by examiner

DOWNHOLE SENSOR SYSTEMS AND METHODS THEREOF

RELATED APPLICATIONS

This application claims priority of U.S. Provisional Patent Application Ser. No. 61/168,218, filed Apr. 10, 2009 the entire contents of which are incorporated herein by reference. This application is a divisional application of U.S. patent application Ser. No. 12/758,031, filed Apr. 12, 2010.

BACKGROUND

The present invention relates to the field of sampling and analysis of geological formations for evaluating and testing the formations for purposes of exploration and development of hydrocarbon-producing wells, such as oil or gas wells. More particularly, the present disclosure is directed to methods and systems utilizing a downhole apparatus having an array of sensors that is configured or designed with discrete, independent sensors having individualized control and communication functionality. In this, the present disclosure provides downhole sensor system architecture for well logging tools utilizing plug and play configurations that are configured or designed for downhole oilfield applications.

Downhole sampling and analysis is an important and efficient investigative technique typically used to ascertain characteristics and nature of geological formations having hydrocarbon deposits. In this, typical oilfield exploration and development includes downhole sampling and analysis for determining petrophysical, mineralogical, and fluid properties of hydrocarbon reservoirs. Such characterization is integral to an accurate evaluation of the economic viability of a hydrocarbon reservoir formation.

Typically, a complex mixture of fluids, such as oil, gas, and water, is found downhole in reservoir formations. The downhole fluids, which are also referred to as formation fluids, have characteristics, including pressure, temperature, volume, among other fluid properties. In order to evaluate underground formations surrounding a borehole, it is often desirable to characterize the fluids, including composition analysis, fluid properties and phase behavior. Wireline formation testing tools are disclosed, for example, in U.S. Pat. Nos. 3,780,575 and 3,859,851, and the Reservoir Formation Tester (RFT) and Modular Formation Dynamics Tester (MDT) of Schlumberger are examples of such tools.

Recent developments in downhole sampling and analysis include techniques for isolating and characterizing formation fluids downhole in a wellbore or borehole. In this, the MDT may include one or more fluid analysis modules, such as the Composition Fluid Analyzer (CFA) and Live Fluid Analyzer (LFA) of Schlumberger, for example, to analyze downhole fluids sampled by the tool while the fluids are still located downhole. In such downhole sampling and analysis modules, formation fluids that are to be sampled and analyzed downhole flow past a sensor module associated with the sampling and analysis module. Such downhole sampling and analysis modules also typically include other sensor types to acquire relevant and important data regarding the geological formations.

In typical sensor modules of the type described above, the sensors are an integral part of the module, and the downhole tool is configured or designed for operation with a fixed and specific sensor configuration. In this, addition or removal of a sensor unit requires redesign and reconfiguration of the tool including control and communication functionality associated with the tool. Increasing the size of a sensor array means that the overall tool size has to be increased to accommodate the additional sensor units. Similarly, repair of one or more sensor unit requires that the complete tool be shipped or transported for the required operation. In addition, field testing of new sensor designs is done by building a new tool prototype including the new sensors which adds complexity to new sensor development and testing.

As the design and development of new sensors has progressed and the capability of downhole analysis has grown a need has been felt for flexible and configurable downhole tool architecture that provides easy sensor attachment and removal. In this, the availability of downhole sensors that are discrete units having independent control and communication capability would eliminate some of the limitations that exist in typical fixed architecture sensor systems for downhole analysis.

Accordingly, it will be appreciated that there exists a desire to improve upon conventional downhole sensor systems in order to make the systems more flexible and adaptable for downhole applications. The present applicants recognized that existing downhole systems of the type described above could be improved by implementing new mechanical, electrical and software infrastructure that facilitates discrete, modular sensor units based on plug and play architecture.

The limitations of conventional systems noted in the preceding are not intended to be exhaustive but rather are among many which may reduce the effectiveness of previously known downhole systems. The above should be sufficient, however, to demonstrate that downhole sensor systems existing in the past will admit to worthwhile improvement.

SUMMARY OF THE DISCLOSURE

In consequence of the background discussed above, and other factors that are known in the field of downhole sampling and analysis systems, the present disclosure provides improved sensor system architecture for methods and systems for downhole characterization of geological formations. In particular, some embodiments of the present disclosure provide methods and systems that utilize novel sensor array architecture having plug and play capability and discrete, independent sensor elements with associated communication and control capabilities.

In some embodiments of the present disclosure, a downhole tool or module is configured or designed to support sensor plug and play capability. In this, discrete sensor units are provided having standardized power supply, communication and mechanical interface; standardized interface with fluids in the flowline of the downhole tool, i.e., standardized flowline and pressure sealing configurations, for downhole fluid analysis (DFA); independent communication capability including ability to send and receive commands/query with a controller; independent control and configuration capability including ability to establish an initial communication between the controller and sensor(s) and to configure one another through an appropriate sequence of commands including reconfiguration of the controller and sensor(s) to accommodate the use of specified sensor units. The sensor units are configured or designed to interface with the downhole tool so that hardware modifications are not necessary, i.e., the physical installation of the sensor units is standardized.

In other embodiments of the present disclosure, the plug and play architecture disclosed herein provides the capability of using the same type of sensor(s) in various types of tool conveyances without having to modify the tools so that uniformity in data acquisition is possible across different tool systems.

According to one aspect of the present disclosure, there is provided a downhole fluid characterization apparatus configured for operation downhole, within a borehole. The apparatus includes a fluid analysis module having a sensor array with each sensor of the sensor array being configured or designed for sensing a specific characteristic of a surrounding formation. The sensors are arranged as discrete units and associated with a flowline of the fluid sampling and analysis module. Each sensor includes individualized and independent control and communication capability in association with system control and telemetry units.

In some aspects of the present disclosure, a downhole fluid characterization system configured for operation downhole, within a borehole, is provided. The system includes a fluid sampling and analysis module having a housing; a flowline in the housing for fluids withdrawn from a formation to flow through the fluid sampling and analysis module downhole, within a borehole, the flowline having a first end for the fluids to enter and a second end for the fluids to exit the fluid sampling and analysis module; a sensor array having a plurality of sensors arranged in fluid communication with the flowline to sense selected formation parameters; and a control system configured or designed for selective and independent operation of each sensor of the sensor array. Each sensor of the sensor array includes a discrete sensor unit configured or designed for individual and independent communication and control.

In some embodiments of the present disclosure, each sensor of the sensor array may have an associated electronics module that provides standardized electronic connectivity with the control system. In other embodiments herein, the same electronics module may be associated with each sensor of the sensor array.

In yet other embodiments herein, each sensor of the sensor array is arranged in a corresponding sensor port so that each sensor is in fluid communication with the flowline. In some aspects, each sensor of the sensor array may be accessible from outside the housing. In yet other aspects of the present disclosure, each sensor of the sensor array may be interchangeable and replaceable.

In some embodiments of the present disclosure, each sensor of the sensor array is located inside the housing. Further embodiments include each sensor of the sensor array interconnected with at least one other sensor of the sensor array. In aspects disclosed herein, the fluid sampling and analysis module includes a sensor block and a plurality of sensor ports in the sensor block configured or designed for retaining the plurality of sensors of the sensor array. In yet other aspects disclosed herein, the sensor ports and each sensor of the sensor array may have corresponding standardized shapes so as to be interchangeable. Certain embodiments of the present disclosure provide each sensor of the sensor array located on the flowline. Each sensor of the sensor array may be located inside the housing, and include a section of the flowline and an electrical connector. The plurality of sensors may be arranged linearly such that the flowline section and electrical connector of each sensor is connected with a corresponding flowline section and electrical connector of at least one other sensor of the sensor array. Each sensor of the sensor array may be tubular in shape and the plurality of sensors may have the same outer diameter.

In some embodiments disclosed herein, the control system may be configured or designed to communicate with a surface system for control and communication of each sensor of the sensor array. In further embodiments, the control system may be configured or designed to provide the surface system with the location and identity of each sensor of the sensor array based on, for example, plug and play architecture. The control system may be configured or designed for data telemetry with the surface system for control and configuration of each sensor of the sensor array and/or the control system may be configured or designed to acquire sensor data from each sensor of the sensor array. In some embodiments disclosed herein, the control system may include a plurality of sensor control systems, each sensor control system being integrated with a corresponding sensor of the plurality of sensors.

A tool is provided for sampling and characterizing formation fluids located downhole in an oilfield reservoir. The tool includes a fluid analysis module having a flowline for fluids withdrawn from a formation to flow through the fluid analysis module, the flowline having a first end for the fluids to enter and a second end for the fluids to exit the fluid analysis module; and a sensor array having a plurality of sensors arranged in fluid communication with the flowline to sense selected formation parameters, wherein each sensor of the sensor array comprises a discrete sensor unit configured or designed for individual and independent communication and control.

In yet other aspects of the present disclosure, a system is provided that is configured for operation downhole in one or more boreholes. The system includes a first tool having a first sensor receptacle for receiving a sensor, and a second tool having a second sensor receptacle for receiving a sensor. The first and second sensor receptacles each have the same configuration and the first and second tools are different types of tools.

A method of downhole characterization of formation fluids utilizing a downhole tool is provided. The method includes deploying a tool downhole for sampling and characterizing formation fluids located downhole in an oilfield reservoir. The tool including a fluid analysis module having a flowline for fluids withdrawn from a formation to flow through the fluid analysis module, the flowline having a first end for the fluids to enter and a second end for the fluids to exit the fluid analysis module. The method further includes providing a sensor array having a plurality of sensors in fluid communication with the flowline to sense selected formation parameters; and configuring a control system for selective and independent operation of each sensor of the sensor array, wherein each sensor of the sensor array comprises a discrete sensor unit configured or designed for individual and independent communication and control. In some aspects disclosed herein, the method may include inputting tool configuration into a control and communication module; inputting sensor configuration into the control and communication module; configuring a data acquisition system based on the sensor configuration; initiating tool communication; verifying tool and sensor configurations; and commencing data acquisition based on the result of the verification of tool and sensor configurations.

Additional advantages and novel features will be set forth in the description which follows or may be learned by those skilled in the art through reading the materials herein or practicing the principles described herein. Some of the advantages described herein may be achieved through the means recited in the attached claims.

THE DRAWINGS

The accompanying drawings illustrate certain embodiments and are a part of the specification. Together with the following description, the drawings demonstrate and explain some of the principles of the present invention.

Figure 4A:
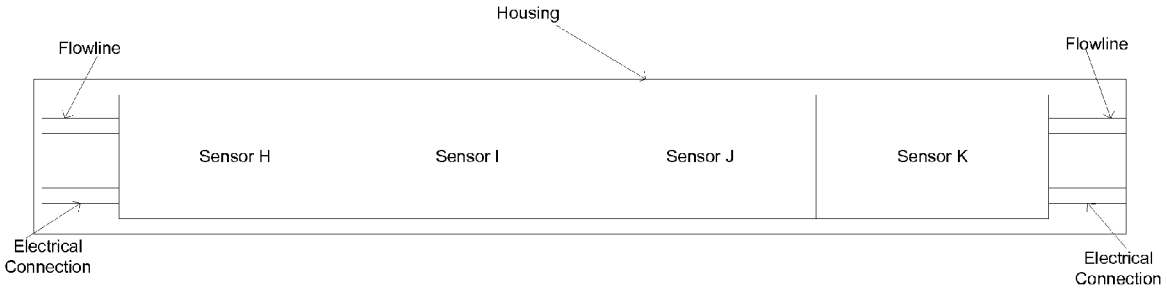
Figure 4B:
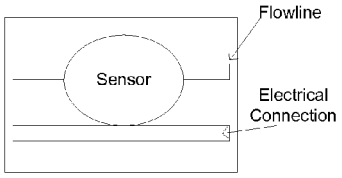

FIGS. 4A and 4B schematically illustrate yet other possible embodiments of a downhole tool module according to the present disclosure.

FIGS. 5A-5D depict various interface configurations for discrete sensor units according to the present disclosure.

Figure 6:
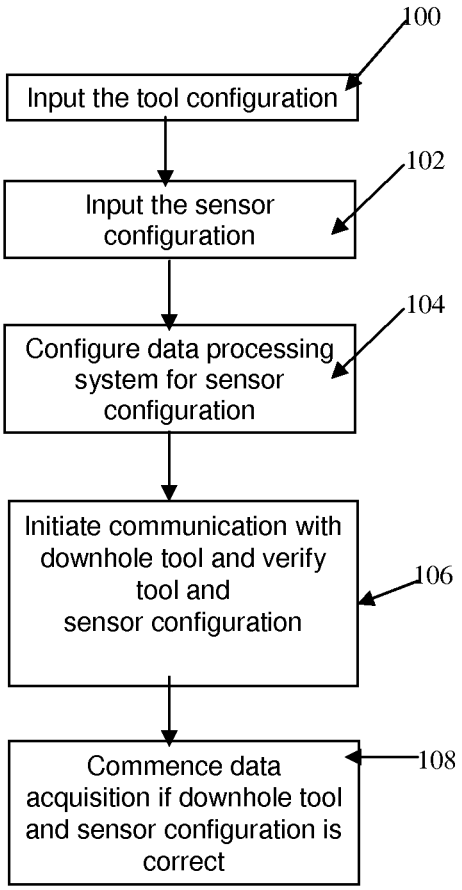

FIG. 6 is a flowchart of one possible method for downhole fluid analysis using discrete sensor units according to the present disclosure.

Throughout the drawings, identical reference numbers and descriptions indicate similar, but not necessarily identical elements. While the principles described herein are susceptible to various modifications and alternative forms, specific embodiments have been shown by way of example in the drawings and will be described in detail herein. However, it should be understood that the invention is not intended to be limited to the particular forms disclosed. Rather, the invention includes all modifications, equivalents and alternatives falling within the scope of the appended claims.

DETAILED DESCRIPTION

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having the benefit of this disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present invention. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment of this invention.

The disclosure herein is directed to the concept of various techniques that may be utilized to facilitate and improve downhole analysis of geological formations. The present disclosure contemplates applicability of the disclosed techniques to sensing systems such as viscosity sensors, density sensors, flowrate gauges, sensors of chemicals such as $H_2S$, $CO_2$, $CH_4$, among others, fluorescence detectors, gas-oil ratio (GOR) sensing systems, spectral sensors, and other similar sensing apparatus that typically are used in the monitoring and characterization of underground reservoirs.

As used throughout the specification and claims, the term "downhole" refers to a subterranean environment, particularly in a wellbore. "Downhole tool" is used broadly to mean any tool used in a subterranean environment including, but not limited to, a logging tool, an imaging tool, an acoustic tool, a permanent monitoring tool, and a combination tool.

The various techniques disclosed herein may be utilized to facilitate and improve data acquisition and analysis in downhole tools and systems. In this, downhole tools and systems are provided that utilize arrays of sensing devices that are configured or designed for easy attachment and detachment in downhole sensor tools or modules that are deployed for purposes of sensing data relating to environmental and tool parameters downhole, within a borehole. The tools and sensing systems disclosed herein may effectively sense and store characteristics relating to components of downhole tools as well as formation parameters at elevated temperatures and pressures. Chemicals and chemical properties of interest in oilfield exploration and development may also be measured and stored by the sensing systems contemplated by the present disclosure. The sensing systems herein may be incorporated in tool systems such as wireline logging tools, measurement-while-drilling and logging-while-drilling tools, permanent monitoring systems, drill bits, drill collars, sondes, among others. For purposes of this disclosure, when any one of the terms wireline, cable line, slickline or coiled tubing or conveyance is used it is understood that any of the referenced deployment means, or any other suitable equivalent means, may be used with the present disclosure without departing from the spirit and scope of the present invention.

Certain aspects of the present disclosure are applicable to oilfield exploration and development in areas such as downhole fluid sampling and analysis using one or more fluid sampling and analysis modules in Schlumberger's Modular Formation Dynamics Tester (MDT), for example.

As previously mentioned, the sensing systems of the present disclosure are configured or designed for easy attachment to an existing tool string. In this, it is possible to address customer needs for new sensors to be added to a tool string that is deployed in the field by simply putting the new sensors into the tool string. Total tool cost and tool length may be reduced since additional modules are not required to increase the number of sensors by adding new sensors. In addition, an experimental prototype or an engineering prototype sensor may be deployed to perform field testing by simply placing the new sensor in a tool string using an easy procedure for attachment and configuration of the sensor. Such capability shortens development time and reduces development costs toward commercialization of new sensing systems.

In some of the embodiments disclosed herein, each sensor of the sensor array may have an associated electronics module that provides standardized electronic connectivity with the sensor control system. In this, by using the same standardized electronics module for each sensor in the sensor array, the flexibility of the modular sensor system is maximized. In certain circumstances, it may not be practical to use the same standardized sensor module for all sensor applications. For example, a variety of legacy sensor systems are in use in existing downhole sensing systems. Further, on-going sensor development may not provide sensors that are fully compatible with the electronics of a modular sensor system. Therefore, in situations where compatibility is not available in the sensor electronics the present disclosure proposes use of a standardized electronics module with each sensor of the sensor array.

The applicants have noted various types of electronic compatibility issues that could be addressed by the standardized electronics module of the present disclosure. For example, compatibility issues arise in electronic power supply such as voltage, power, isolation of ground, etc., in the type of tool communication and/or tool control, in specific tool needs such as tool power-up, tool reset, tool programming, etc. To address such issues, the present disclosure proposes a suitably sized standard electronics module that is located at each sensor so that differences between sensors in the sensor array are eliminated as far as possible. Since the standard electronics module would provide uniform connectivity for all types of sensors preexisting sensors, newly developed sensors, and future modular sensors may be utilized in the downhole sensing systems of the present disclosure without undue constraints thereby enabling the plug and play capabilities described herein.

The present disclosure contemplates utilizing the plug and play architecture disclosed herein for downhole tools and equipment that are utilized in different oilfield applications such as wireline, reservoir monitoring or production logging, drilling and measuring, well completions, among others. In this, different types of tools having varying conveyances can easily use the same type of sensors. With such a system, a pressure reading, for example, maybe made with a pressure sensor plugged into a wireline tool during a well-logging operation. A monitoring tool may then be fitted with the same type of sensor as the receptacles for the type of sensors in the wireline and the monitoring tool would be the same. Taking it one step further, the same exact sensor may be used in the various tools by simply unplugging it from one tool and onto another. With the above posed system, it would be easy to correlate the data received with different tools, which would thus facilitate global interpretation of the reservoir since the same type of measurements with the same physics, resolution, accuracy would be obtainable across downhole tool systems. Furthermore, such data could be interpreted using conventional software to provide a much better assessment of the reservoir as an answer product for clients.

As described in further detail below, the plug and play sensors of the present disclosure may be utilized in various types of conveyance systems to obtain measurements utilizing the same sensor(s) or types of sensors. In this, sensors having the same design and calibration characteristics would provide similar data across conveyance systems.

The present disclosure further contemplates applicability of the disclosed techniques in permanent monitoring systems, sub-sea pipelines or completions where after deployment of a sensor carrier multiple sensors can be lowered or changed or maintained without excessive downtime or complex tool alterations and reconfigurations.

Figure 1:
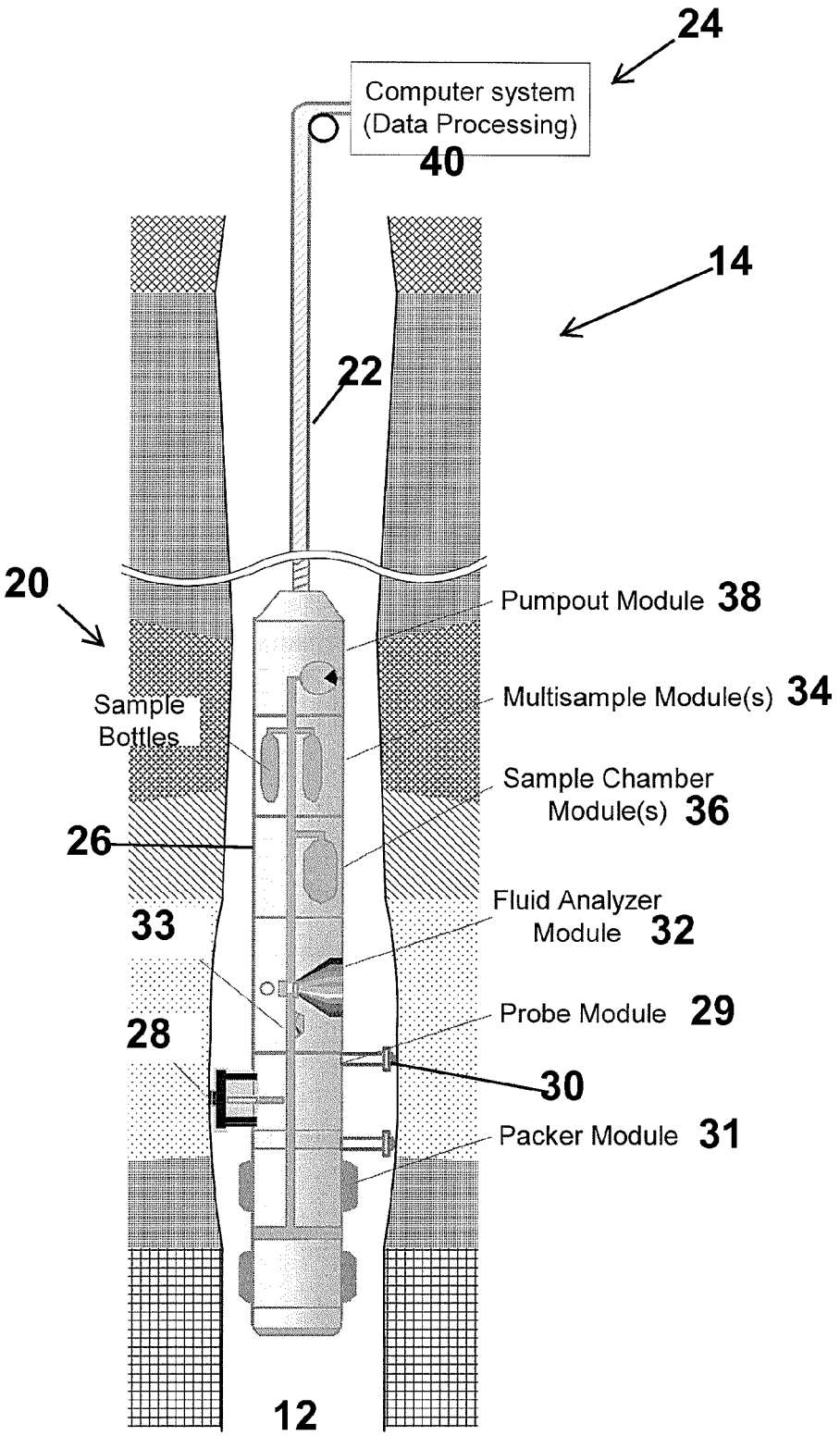
FIG. 1 is a schematic representation in cross-section of an exemplary operating environment of the methods and systems of the present disclosure.

Turning now to the drawings, wherein like numerals indicate like parts, FIG. 1 is a schematic representation in cross-section of an exemplary operating environment of the present disclosure wherein a borehole tool 20 is suspended at the end of a wireline 22 at a wellsite having a borehole or wellbore 12. FIG. 1 depicts one possible setting, and other operating environments also are contemplated by the present disclosure. Typically, the borehole 12 contains a combination of fluids such as water, mud filtrate, formation fluids, etc. The borehole tool 20 and wireline 22 typically are structured and arranged with respect to a service vehicle (not shown) at the wellsite.

The exemplary system of FIG. 1 may be utilized for downhole analysis and sampling of formation fluids. The borehole system includes the borehole tool 20, which may be used for testing earth formations and analyzing the composition of fluids from a formation, associated telemetry and control devices and electronics, and surface control and communication apparatus (designated generally in FIG. 1 as "Computer system"). One example of such systems is the aforementioned MDT tool of Schlumberger.

The borehole tool 20 typically is suspended in the borehole 12 from the lower end of a multiconductor logging cable or wireline 22 spooled on a winch (not shown). The logging cable 22 typically is electrically coupled to a surface electrical control system having appropriate electronics and processing systems for the borehole tool 20. The borehole tool 20 includes an elongated body 26 encasing a variety of electronic components and modules, which are schematically represented in FIG. 1, for providing necessary and desirable functionality to the borehole tool 20. A selectively extendible fluid admitting assembly 28 and a selectively extendible tool-anchoring member 30 are respectively arranged on opposite sides of the elongated body 26. Fluid admitting assembly 28 is operable for selectively sealing off or isolating selected portions of a borehole wall 12 such that pressure or fluid communication with adjacent earth formation is established. The fluid admitting assembly 28 may be a single probe module 29 (depicted in FIG. 1) and/or a packer module 31 (also schematically represented in FIG. 1). Examples of borehole tools are disclosed in the U.S. Pat. Nos. 3,780,575, 3,859,851 and 4,860,581.

One or more fluid sampling and analysis modules 32 are provided in the tool body 26. Fluids obtained from a formation and/or borehole flow through a flowline 33, via the fluid analysis module or modules 32, and then may be discharged through a port of a pumpout module 38. Alternatively, formation fluids in the flowline 33 may be directed to one or more fluid collecting chambers 34 and 36, such as 1, 2¾, or 6 gallon sample chambers and/or six 450 cc multi-sample modules, for receiving and retaining the fluids obtained from the formation for transportation to the surface.

The fluid admitting assemblies, one or more fluid analysis modules, the flow path and the collecting chambers, and other operational elements of the borehole tool 20, are controlled by electrical control systems, such as the surface electrical control system 24. The electrical control system 24, and other control systems situated in the tool body 26, for example, may include processor capability for characterization of formation fluids in the tool 20, as described in more detail below.

The system 14, in its various embodiments, may include a control processor 40 operatively connected with the borehole tool 20. The control processor 40 is depicted in FIG. 1 as an element of the control system 24. Methods disclosed herein may be embodied in a computer program that runs in the processor 40 located, for example, in the control system 24. In operation, the program is coupled to receive data, for example, from the fluid sampling and analysis module 32, via the wireline cable 22, and to transmit control signals to operative elements of the borehole tool 20.

The computer program may be stored on a suitable computer usable storage medium associated with the processor 40, or may be stored on an external computer usable storage medium and electronically coupled to processor 40 for use as needed. The storage medium may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein.

In some embodiments of the present disclosure, the methods and apparatus disclosed herein may be embodied in one or more fluid sampling and analysis modules of Schlumberger's formation tester tool, the Modular Formation Dynamics Tester (MDT). In this, a formation tester tool, such as the MDT, may be provided with enhanced functionality for the downhole characterization of formation fluids and the collection of formation fluid samples. The formation tester tool may be used for sampling formation fluids in conjunction with downhole characterization of the formation fluids.

The present disclosure provides methods and apparatus having multiple, discrete sensors for a downhole fluid analyzer as depicted in FIG. 1. Each sensor of a sensor array is configured or designed for independent attachment and removal using plug and play techniques, and includes control and communication functionality that make the sensor individually controllable and configurable.

Figure 2:
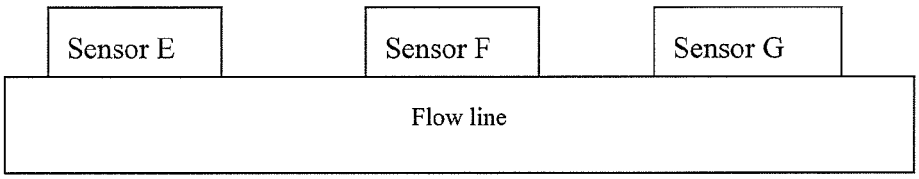
FIG. 2 is a schematic representation of one possible configuration for a downhole tool according to the present disclosure.

FIG. 2 shows one embodiment of a sensor configuration according to the present disclosure. In FIG. 2, a general concept of the present disclosure is illustrated in which the individual sensors are installed directly on the flowline and may be located inside the tool housing (not shown) or may be accessible from outside the tool housing (note FIG. 3). As depicted in the exemplary embodiment of FIG. 2, each sensor may be individually connected or attached to the flowline and may be configured or designed to communicate with surface apparatus individually or through a control board. Each sensor in the sensor array may be provided with plug and play capability and may be configured or designed so as to have independent control and communication features. In this, standardized sensor shape(s) and/or standardized receptacles or sockets may or may not be provided according to the principles disclosed herein. In the embodiment of FIG. 2, it is possible to provide standard mechanical interface between the flowline and the sensor package to derive significant design flexibility of the sensor packaging without increasing tool complexity.

Figure 3:
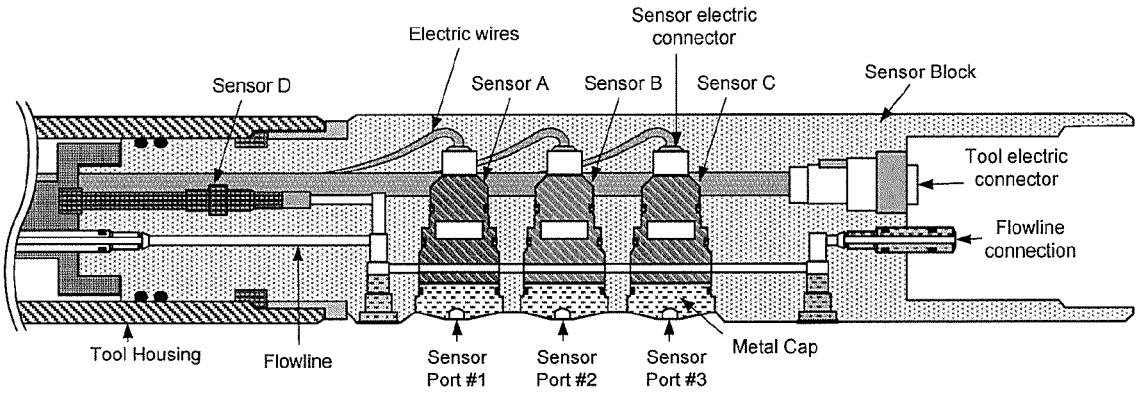
FIG. 3 depicts one possible configuration for downhole analysis of formation fluids according to the present disclosure.

FIG. 3 shows one possible configuration of a formation tester tool for downhole fluid sampling and analysis. A fluid analyzer module is included in a tool string such as depicted in FIG. 1 and includes a sensor array having multiple sensors for fluid analysis downhole. In one possible configuration, as depicted in FIG. 3, one or more sensors (for example, Sensors A-C in FIG. 3) can be installed in one or more sensor ports (for example, Sensor Ports 1-3 in FIG. 3) in the fluid analyzer module.

The present disclosure envisions a standardized sensor that can be installed in any one of multiple sensor ports. Plug and play sensor capability is provided by a surface acquisition system that is capable of recognizing the specific sensor that is installed in a particular sensor port without excessive reconfiguration or modifications to the existing system. In this, a surface acquisition system has the ability to link with sensor data processing software so that the entire system operates in a seamless manner with reliability and safety.

In one possible embodiment of the present disclosure, the tool configuration may be input to a surface computer system (note again FIG. 1). Tool configuration provides the surface system with information about what tool modules are included in the tool string and the arrangement of the modules, for example, the arrangement of the tool string (note FIG. 1) is input into a surface control system before downhole deployment of the tool string. Configuration for the fluid analyzer sensor may also be input to the surface computer, for example, the order and positions of the sensors in the fluid analyzer module (note FIG. 3) is input into the surface control systems. In this, the present disclosure contemplates various possibilities such that configuration data may be manually input by an operator and/or may be directly provided by the downhole tools using appropriate plug and play functionality. In either case, the surface computer links with data processing software that are associated with the installed sensors. Such data processing software may be configured or designed for processing data from the downhole tools and sensors. Sensor electronics associated with each sensor or sensor module are configured or designed to provide sensor data to surface systems using suitable data telemetry. Communication with the downhole tool is commenced by the surface computer to verify whether or not the tool and sensor configurations are correct. Once the downhole tool and the tool and sensor configurations are verified and confirmed as accurate, the surface computer commences data acquisition from the downhole tool. In this manner, an easy to use plug and play type architecture is provided between surface data acquisition systems and downhole tools having multiple sensors in a sensor array.

In the embodiment of FIG. 3, tool structure is provided for supporting three slots or cups for plug and play sensors (A, B, C) in a modular sensor block. It is noted that the number of sensors and sensor slots is not limited to three and any number that are desired may be provided. The sensor design and size, and the sensor slots are standardized so that it is possible to install individual sensors into any of the sensor spaces that are provided in the sensor block. The sensors and sensor slots of FIG. 3 may be accessed directly from outside the tool housing, and it is not necessary to extract the electronics chassis of the module from the housing in order to install or remove sensors.

FIG. 3 also shows an additional Sensor D having a different configuration from Sensors A-C. Sensor D is installed in a sensor port in the block, but is not directly accessible from outside the tool housing. However, Sensor D has a small package size with common electronics and harness interface thereby providing additional capability to the sensor configuration. In the example of Sensor D, plug and play capability is maintained for the electronics and/or software portions of the sensor architecture so that overall tool length is reduced while the total number of sensors in the module is increased.

FIGS. 4A and 4B show a sensor array architecture in which multiple sensors are arranged inside a tool housing in a chain fashion. Each sensor of the array includes a flowline and electrical connection portion (note FIG. 4B) that interconnect with adjacent sensors or modules of the downhole tool string. In the configurations of FIGS. 4A and 4B, sensors can be removed or added simply by separating or attaching the connector portions. Suitable mechanical connectors, such as stabber connectors, may be used to mechanically connect and retain the interconnected sensors. Therefore, arrangement or rearrangement of sensor positions and replacement with other sensors is easily accomplished without excessive downtime and tool modifications. Moreover, the housing casing surrounds the interconnected sensors so that mechanical stability and protection is provided to the sensor module and to humans in the vicinity of the tool. For example, the housing casing in the embodiments depicted in FIGS. 4A and 4B provides safety to tool operators from explosive internal pressure inside the tool.

Figure 5A:
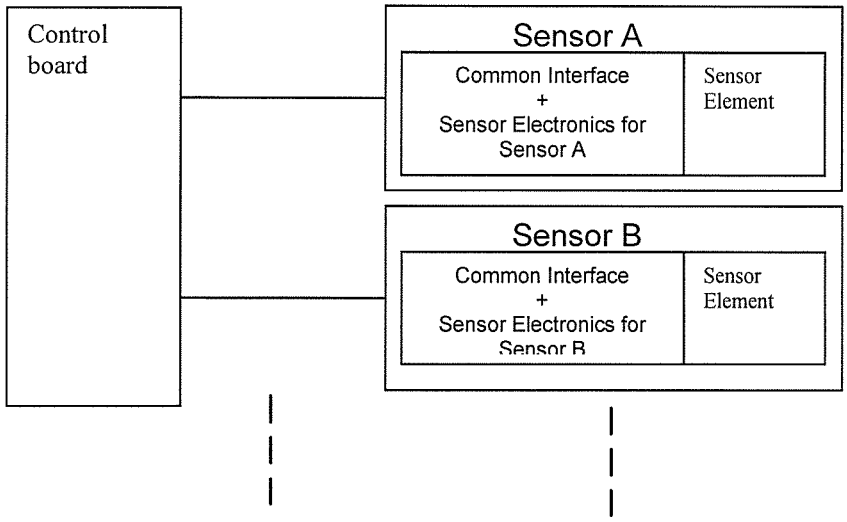
Figure 5B:
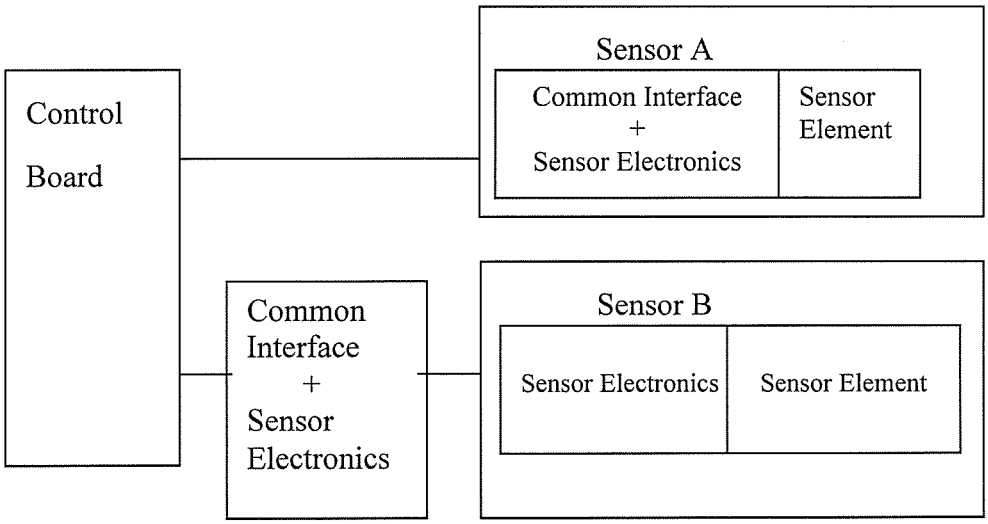

FIGS. 5A and 5B show interface architecture between a control board and an array of sensors. As described above, each sensor according to the present disclosure has a common interface, sensor electronics and sensor communication capability. The control board supports the common interface which communicates with the sensors for control and data acquisition. For example, the common interface may be any one of Serial Peripheral Interface (SPI), Controller Area Network (CAN), RS232, types of communication protocols. The sensor harnesses and connectors may be common to all sensors. As the sensor communication protocol and data format are the same, the control board does not need to know what sensor is connected to which port. The control board sends a command and/or query from the surface computer to each sensor in sequence, and acquires data sequentially from the interconnected sensors. The acquired data are sent to the surface computer using telemetry.

FIG. 5B shows another interface architecture according to the present disclosure. Due to the complexity of sensor electronics, all the sensor electronics may not be installed into the sensor package, and an additional sensor electronics board may be provided for the purpose. In the case of FIG. 5B, the cartridge sensor includes an open space for the additional board.

Figure 5C:
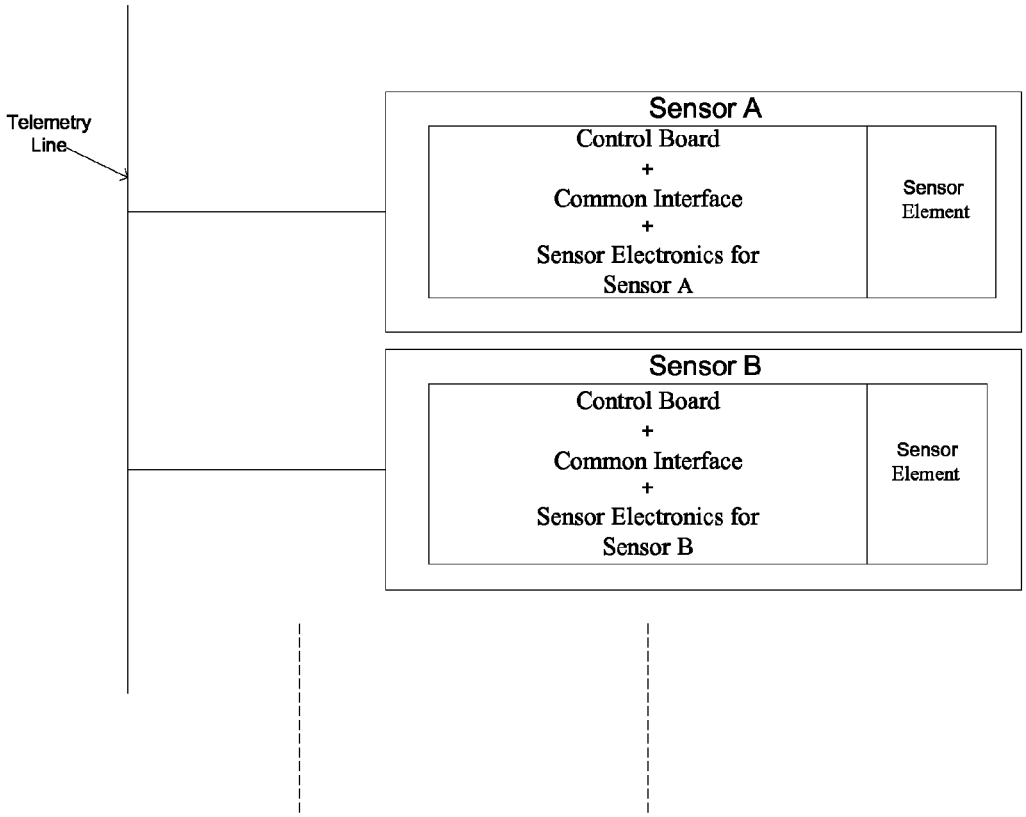

FIG. 5C depicts yet another interface architecture for the sensor array according to the present disclosure. In the embodiment of FIG. 5C, each sensor in the sensor array is directly connected with a telemetry line for control and communication functions. The configuration depicted in FIG. 5C provides added independence and configurability to each sensor in the array since intermediate electronics are included in the sensor package and direct connection with the telemetry line is available.

Figure 5D:
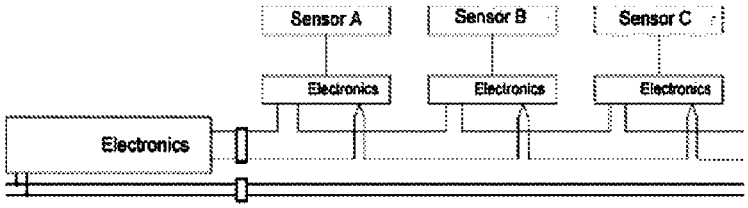

FIG. 5D depicts yet another interface architecture for the sensor array according to the present disclosure. In the embodiment of FIG. 5D, each sensor in the sensor array has an electronics module associated with it such that standardized connectivity is provided to the electronics of the control/telemetry system. As previously discussed above, the configuration depicted in FIG. 5D provides added flexibility to each sensor in the array since a variety of sensors may be utilized with less compatibility issues. In this, it is envisioned that the same electronics package may be provided at each sensor thereby simplifying the overall architecture of the downhole sensing system.

FIG. 6 is one possible method for downhole fluid analysis using the systems of the present disclosure. A downhole tool is deployed for data acquisition downhole in a borehole. Tool configuration is input into the control system (Step 100) and the sensor configuration is input (Step 102) so that the overall system is configured and ready for operation (Step 104). After verification of tool and sensor configurations (Step 106) data acquisition for downhole sensors is commenced (Step 108).

Generally, the techniques disclosed herein may be implemented on software and/or hardware. For example, they can be implemented in an operating system kernel, in a separate user process, in a library package bound into telemetry and/or network applications, on a specially constructed machine, or on a network interface card. In one embodiment, the techniques disclosed herein may be implemented in software such as an operating system or in an application running on an operating system.

A software or software/hardware hybrid implementation of the present techniques may be implemented on a general-purpose programmable machine selectively activated or reconfigured by a computer program stored in memory. Such a programmable machine may be implemented on a general-purpose network host machine such as a personal computer or workstation. Further, the techniques disclosed herein may be at least partially implemented on a card (e.g., an interface card) for a network device or a general-purpose computing device.

The preceding description has been presented only to illustrate and describe the invention and some examples of its implementation. It is not intended to be exhaustive or to limit the invention to any precise form disclosed. Many modifications and variations are possible in light of the above teaching. The aspects herein were chosen and described in order to best explain principles of the invention and its practical applications. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A downhole fluid characterization system configured for operation downhole, within a borehole, comprising:

a fluid sampling and analysis module, the fluid sampling and analysis module comprising:

a housing;

a flowline in the housing for fluids withdrawn from a formation to flow through the fluid sampling and analysis module downhole, within a borehole, the flowline having a first end for the fluids to enter and a second end for the fluids to exit the fluid sampling and analysis module;

a sensor array having a plurality of sensors arranged in fluid communication with the flowline to sense selected formation parameters; and a control system configured or designed for selective and independent operation of each sensor of the sensor array, wherein each sensor of the sensor array has an associated electronics module that provides standardized electronic connectivity with the control system.

2. The downhole fluid characterization system according to claim 1, wherein each sensor of the sensor array is interchangeable and replaceable.

3. The downhole fluid characterization system according to claim 1, wherein each sensor of the sensor array is interconnected with at least one other sensor of the sensor array.

4. The downhole fluid characterization system according to claim 1, wherein the same electronics module is associated with each sensor of the sensor array.

5. The downhole fluid characterization system according to claim 1, wherein each sensor of the sensor array is arranged in a corresponding sensor port so that each sensor is in fluid communication with the flowline.

6. The downhole fluid characterization system according to claim 5, wherein each sensor of the sensor array is accessible from outside the housing.

7. The downhole fluid characterization system according to claim 1, wherein each sensor of the sensor array includes a section of the flowline and an electrical connector, wherein the plurality of sensors are arranged linearly such that the flowline section and electrical connector of each sensor is connected with a corresponding flowline section and electrical connector of at least one other sensor of the sensor array.

8. The downhole fluid characterization system according to claim 7, wherein each sensor of the sensor array is tubular in shape and the plurality of sensors have the same outer diameter.

9. The downhole fluid characterization system according to claim 1, wherein the control system is configured or designed to communicate with a surface system for control and communication of each sensor of the sensor array.

10. The downhole fluid characterization system according to claim 9, wherein the control system is configured or designed for data telemetry with the surface system for control and configuration of each sensor of the sensor array.

11. The downhole fluid characterization system according to claim 9, wherein the control system is configured or designed to acquire sensor data from each sensor of the sensor array.

12. The downhole fluid characterization system according to claim 9, wherein the control system comprises a plurality of sensor control systems, each sensor control system being integrated with a corresponding sensor of the plurality of sensors.

13. The downhole fluid characterization system according to claim 9, wherein the control system is configured or designed to provide the surface system with the location and identity of each sensor of the sensor array.

14. The downhole fluid characterization system according to claim 13, wherein the control system automatically provides the surface system with the location and identity of each sensor of the sensor array based on plug and play architecture.

15. A method of downhole characterization of formation fluids utilizing a downhole tool comprising:

deploying a tool downhole for sampling and characterizing formation fluids located downhole in an oilfield reservoir, the tool comprising:

a fluid analysis module, the fluid analysis module comprising:

a flowline for fluids withdrawn from a formation to flow through the fluid analysis module, the flowline having a first end for the fluids to enter and a second end for the fluids to exit the fluid analysis module;

providing a sensor array having a plurality of sensors in fluid communication with the flowline to sense selected formation parameters; and configuring a control system for selective and independent operation of each sensor of the sensor array, wherein each sensor of the sensor array comprises a discrete sensor unit configured or designed for individual and independent communication and control.

16. The method of downhole characterization of formation fluids according to claim 15, further comprising:

inputting tool configuration into a control and communication module;

inputting sensor configuration into the control and communication module;

configuring a data acquisition system based on the sensor configuration;

initiating tool communication;

verifying tool and sensor configurations; and commencing data acquisition based on the result of the verification of tool and sensor configurations.

* * * * *